US005415395A

United States Patent [19]

Bartoli

[11] Patent Number: 5,415,395

[45] Date of Patent: May 16, 1995

[54] DEFORMABLE BASE CONSTRUCTION

[76] Inventor: Ronald W. Bartoli, 18484 Chapparell Dr., Penn Valley, Calif. 95946

[21] Appl. No.: 277,034

[22] Filed: Jul. 19, 1994

[51] Int. Cl.[6] ..... A63B 71/00

[52] U.S. Cl. ..... 273/25

[58] Field of Search ..... 273/25

[56] References Cited

U.S. PATENT DOCUMENTS

| | | | |
|---|---|---|---|
| 3,971,558 | 7/1976 | Gardetto | 273/25 |
| 4,723,779 | 2/1988 | Hauser | 273/25 |
| 4,976,430 | 12/1990 | Brandon | 273/25 |
| 5,000,447 | 3/1991 | Bartoli | 273/25 |
| 5,080,356 | 1/1992 | Green | 273/25 |
| 5,251,894 | 10/1993 | Boatman | 273/25 |
| 5,290,028 | 3/1994 | Bartoli | 273/25 |

*Primary Examiner*—Theatrice Brown
*Attorney, Agent, or Firm*—Foley & Lardner

[57] ABSTRACT

A deformable base having top and peripheral walls and resiliently deformable interior ribs is formed with a recess in the interior central crown region, the recess being defined by a central web to which a mounting plate is removably attached. The plate is elevated above the ground-engaging parts of the base as a result of which the central web and plate can be downwardly depressed when vertical impact forces caused by a runner contacting the crown region are encountered. This downward depression together with the resiliency of the ribs provides a more uniform absorption of vertical impact forces across the entire top surface of the base thereby eliminating hard and soft areas likely to cause injury.

4 Claims, 2 Drawing Sheets

DEFORMABLE BASE CONSTRUCTION

BACKGROUND OF THE INVENTION

The present invention relates as indicated to a deformable base construction, and relates more particularly to a base capable of absorbing impact forces thereby minimizing injury to players.

An important requirement for baseball or softball bases, particularly at the major league or other high levels of play, is that the base must be mounted to prevent lateral shifting in order for the base to remain in its proper position. There are several ways of accomplishing such mounting, including the use of a long spike which engages a strap affixed to the bottom of the base for securing the base when the spike is driven into the ground. Another commonly used base, and one which is used at the major and minor league levels, is formed with a post which extends into a complimentary shaped retaining sleeve embedded in the soil. The connection is non-rotating, with the post and retaining sleeve assembly thus precluding the base from either rotating or shifting laterally. In both of these known bases, substantial lateral impact forces result when a player slides into the side of the base.

The prior art has suggested dealing with these impact forces in several ways. One such way is to provide a base that breaks away from its mounting when impact forces above a certain level are encountered. U.S. Pat. No. 4,398,715, discloses a base in which the top is detachably secured to a ground plate. When force above a certain level is encountered, the detachable upper portion of the base breaks away from the fixed ground plate. The detachable connection is provided by numerous anchoring points all of which must be secured in order to reattach the base to the plate after the base has broken away.

A different approach is disclosed in applicant's prior U.S. Pat. No. 5,000,447. In the patented base construction, rather than providing a break away base, the base is formed with resilient, inwardly deformable ribs which function to absorb the sliding impact forces, with the resiliency of the ribs returning the ribs to their normal position when the impact forces are terminated.

The base disclosed in applicant's prior U.S. Pat. No. 5,290,028 is similarly laterally inwardly deformable upon impact, but additionally provides a connection between the post and the base such that the base can be separated from the post when the lateral impact forces exceed a predetermined level.

SUMMARY OF THE INVENTION

The present invention includes many of the desired features from the base constructions disclosed in applicant's previous patents above referred to. The underside of the base includes numerous resilient, deformable ribs which are displaced inwardly toward the center of the base in response to impact forces resulting from the sliding action. In addition, the top and peripheral walls of the base are of reduced overall height, and the top of the base tapers downwardly from the center toward the peripheral wall thereby enhancing the possibility of a player sliding up and over the base rather than directly into the base which can result in possible injuries. The unique feature of the present invention is the achieving of generally uniform resistance to downward pressure across essentially the entire top surface of the base. In arrangements where there is a relatively solid center mount arrangement, there can at least theoretically be significant differences in resistance to vertical impact forces between the region at the relatively solid center part of the base and the ribbed regions around the center extending to the periphery. This can become more pronounced upon continued use of the base since there is a greater tendency to engage the areas of the base around the center as opposed to engaging the base only at the center of the base. This could decrease the resistance to vertical impact forces in the ribbed areas around the center mounting of the base, thereby resulting in areas that substantially differ in the ability to absorb the vertical impact forces.

The objective of achieving more uniform impact resistance to vertical forces applied to the base is achieved in accordance with the present invention by providing a base construction in which the center of the base in the region of the post and mounting sleeve is internally recessed, thereby permitting the top surface of the base to move relative to the ground support, in much the same manner as the surrounding ribs permit vertical movement of the top surface of the base in the regions surrounding the center of the base. As a result, the entire top surface of the base is able to more uniformly absorb vertical impact forces resulting from players engaging the top of the base. By absorbing more uniformly the vertical impact forces, "harder" or "softer" areas on the top surface of the base are eliminated thereby reducing the tendency of players to turn ankles or suffer other injuries when engaging the top of the base.

In accordance with the preferred embodiment of the invention, a resilient center web extends downwardly from the top wall of the base and the resiliently deformable ribs are connected at their inner ends to the center web and at their outer ends to the peripheral wall. The base is secured through a mounting plate to a post adapted to be received in a sleeve embedded in the ground. The base is recessed above the plate and within the connecting web thereby providing an open area into which the top of the base can extend when vertical impact forces are encountered.

A further feature of the invention is to provide a base mounting arrangement in which relative movement is permitted between the mounting post and the embedded sleeve when vertical impact forces are encountered. This is accomplished by removably mounting the mounting plate to the connecting web, with the connecting web and consequently the mounting being vertically moveable when vertical forces on the top surface of the base are encountered by a player contacting the base. As a result, the mounting plate which carries the post moves vertically downwardly within the fixed, embedded sleeve during such impact, and when the impact forces are removed, the resilience of the connecting web and material from which the base is constructed return the mounting plate and consequently the post to its rest position. This in effect creates a "piston" arrangement completely accommodative of the vertical downward movement of the top center of the base during impact, as a result of which the downward forces are more uniformly absorbed across the entire width of the base.

In accordance with the preferred embodiment, a plurality of internally threaded inserts are embedded in the center web during the molding process, and the mounting plate is formed with a plurality of mounting holes adjacent the periphery thereof through which mounting screws can be inserted into threaded engagement with the inserts. The mounting plate can thus be removably attached to the center web and consequently the base, and can be quickly and easily removed from its connection to the web when necessary or desirable. For example, the recess above the plate can be filled with resilient foam plastic of varying hardness to achieve an even more uniform resistance to vertical impact forces.

This avoids the inflexibility resulting from the imbedding of the mounting plate in a solid center hub portion of the base.

These and other objects will become apparent as the following description proceeds in particular reference to the application drawings.

BRIEF DESCRIPTION OF THE APPLICATION DRAWINGS

DETAILED DESCRIPTION OF THE PREFERRED EMBODIMENTS

Figure 1:
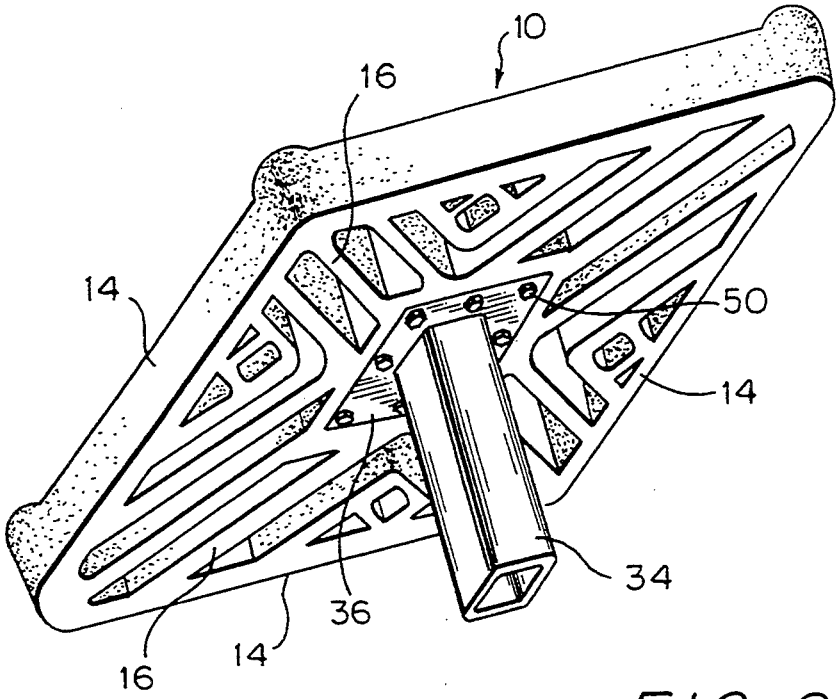
FIG. 1 is a bottom perspective view of the deformable base construction in accordance with the present invention.

Referring now in more detail to the application drawings, wherein like parts are indicated by like reference numerals, the deformable base construction in accordance with the present invention is generally indicated at 10, with the body of the base comprising a top wall 12 and peripheral walls commonly designated at 14 integrally formed with the top wall. The underside of the base is hollow except for a series of resilient, deformable ribs commonly designated at 16, and a center web 18. The ribs 16 extend between the top wall and terminate at their lower ends in a horizontal plane coincident with the bottom surfaces of the peripheral walls 14. A majority of the ribs extend entirely between the peripheral walls and the center rib 18, and extend at an angle to facilitate deformation when sliding impact forces engage the base on a side thereof. The ribs formed approximately intermediate each corner of the base do not extend completely to the center web 18, but are likewise formed at an angle as clearly seen in FIG. 3.

Figure 2:
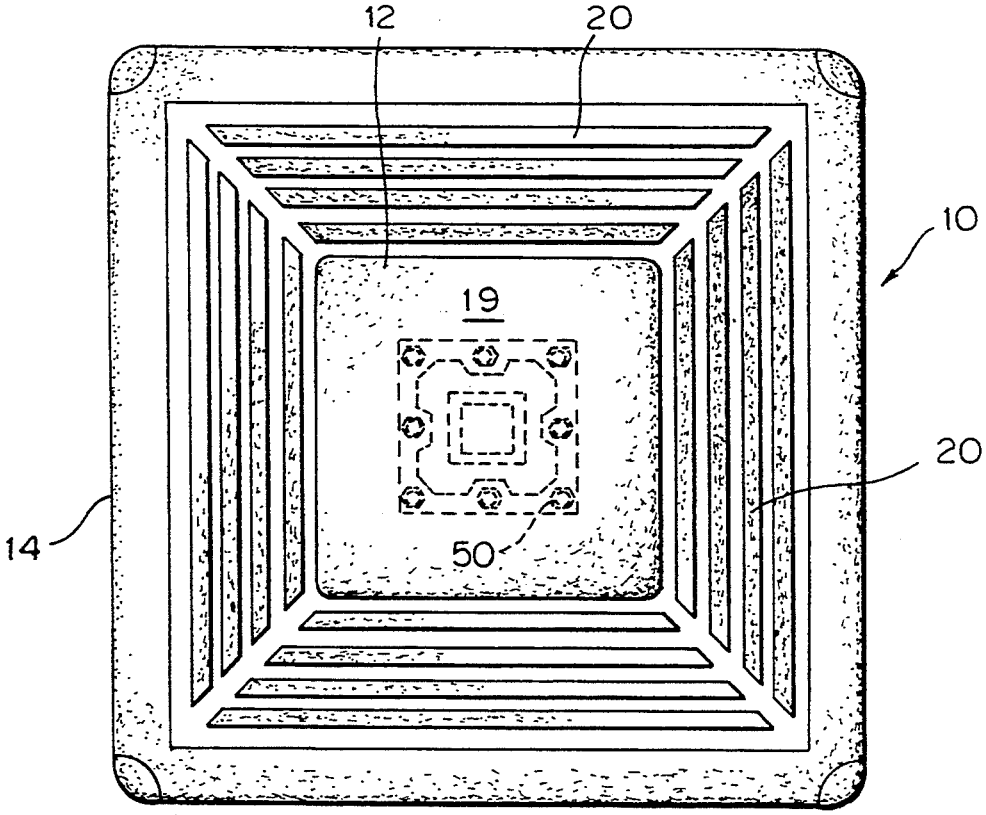
FIG. 2 is a top plan view of the base.
Figure 4:
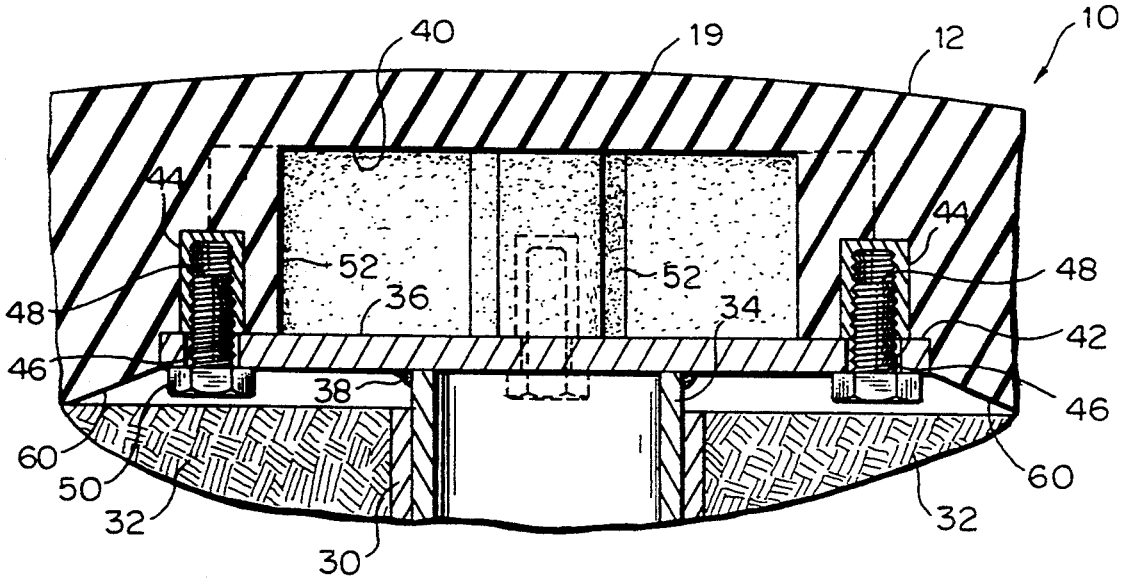
FIG. 4 is a greatly enlarged cross sectional view taken on line 4—4 of FIG. 3, showing in greater detail the manner in which the mounting plate is removably attached to the center web.

The crown 19 of the base is slightly rounded as shown in FIG. 4, and a series of spaced ridges commonly designated at 20 (FIG. 2) are provided between the crown 18 and the peripheral walls 14 to provide additional traction to the base runner. The tread design provided by the spaced ridges 20 is not absolutely necessary, and other tread designs could also be provided.

The base 10 is made of rubber or other resiliently deformable material, and is preferably formed by molding. The hardness of the rubber is preferably in the range of 52 to 70 as measured by a Shore durometer, and the hardness can be selected if desired to correspond in general to the average age and weight of the players. For example, a more resilient or softer base could be provided for lighter weight players younger in age, and a less resilient material could be used for older and heavier players, thereby to correlate the ability to deform with the impact forces encountered.

The height of the peripheral walls 14 is preferably substantially less than the height of the base through the crown portion. This provides a substantial downward taper from the crown to each side of the base thereby enhancing the chances of a sliding player sliding upwardly over the side edge of the base during the slide. In such event, ankle or leg injuries are not likely to occur. However, where the player slides directly into the side of the base, there is substantial impact force absorbed by the ankle and leg of the player. In such event, due to the rib construction on the underside of the base, the side of the base contacted by the player deforms laterally inwardly so that the force of impact is substantially dissipated. As a result, the chance of the player spraining or breaking an ankle or leg is substantially lessened. Following impact, the resilient nature of the base material returns the deformed portion to its original shape, but not so quickly as to provide a counterforce in the opposite direction which might also cause injury.

Thus far described, except for the center web 18, the invention is similar in most respects to the deformable base disclosed in applicant's earlier U.S. Pat. No. 5,000,447.

The base 10 is mounted by a post and sleeve arrangement as shown in U.S. Pat. No. 5,000,447, although in accordance with the present invention the post is detachably connected to the base in a completely different manner. Referring to FIG. 4, a retaining sleeve 30 is buried in the ground, diagrammatically illustrated at 32, in a permanent fashion. Preferably, the sleeve is covered with a cap (not shown) when the base is not in use to prevent dirt or other material from entering the sleeve. The length of the sleeve is largely dependent upon the length of the post 34, preferably being slightly longer so that the post does not bottom out at the bottom of the sleeve. Both the post 34 and the sleeve 30 are preferably rectangular in cross section so as to prevent rotation of the post, and consequently the base, in the sleeve.

The post is secured at its upper end to a metal mounting plate 36 by spot welding 38 or the like. The crown 19 of the base is formed with a recess 40 of substantial depth which is in turn counterbored at the bottom thereof as shown at 42 to provide an enlarged recess to accommodate the thickness and dimension of the sleeve 36. The counterbore is dimensioned to receive the mounting plate with slight clearance, and in the preferred form both the counterbore and the plate are rectangular in shape, reference being made to FIG. 3.

A plurality of internally threaded inserts commonly designated at 44 are embedded in the rubber during the molding process, with the open end of each insert terminating at the bottom of the counterbore 42. There are eight such inserts in the form shown, located adjacent each corner and midway along each side of the plate. The plate is formed with corresponding smooth openings 46 aligned with the inserts for receiving mounting bolts commonly shown at 48, the heads 50 of which engage the bottom face of the mounting plate when the bolts are tightened to secure the mounting plate in place.

Figure 3:
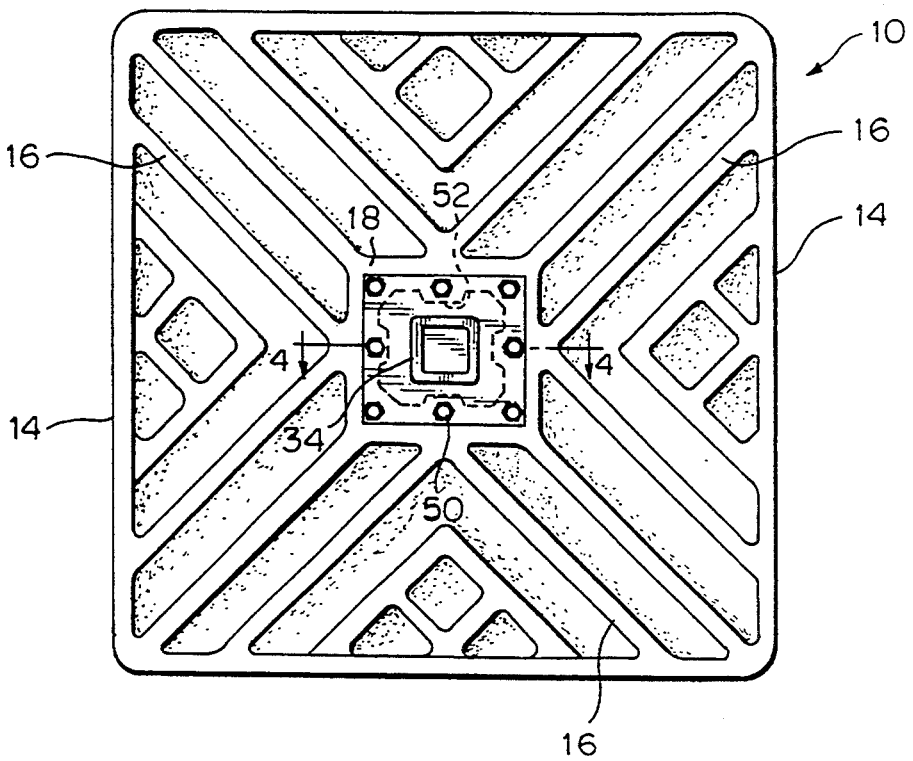
FIG. 3 is a bottom plan view of the base showing the manner in which the mounting plate is mounted to the center web.

As shown most clearly in FIG. 3, the center web is formed with embossments commonly shown at 52 in the regions of the threaded inserts, with the areas of increased thickness providing greater support for the inserts. The reduced thickness of the center web 18 between the embossed regions 52 enhances the ability of the center web to resiliently deform downwardly as will be described in more detail below.

The inserts 44 are preferably formed of steel, as is the mounting plate 36. However, other materials having the requisite characteristics could also be used.

It will be noted that the bottom surfaces 60 of the ribs in the regions where they interconnect with the center web are downwardly and outwardly tapered, and this taper continues until merging or intersecting the coplanar and substantially horizontal bottom surfaces of the ribs and peripheral walls. The base is thus supported in its use position (as shown in FIG. 4) by the ribs and peripheral walls, and not by the crown 19. Thus, the mounting plate 36, the top of the sleeve 34, and the bolt heads 50 are spaced above the upper end of the sleeve 30 and the surrounding earth in which the sleeve is embedded, as clearly shown in FIG. 4.

By elevating the mounting plate from the sleeve and ground, and by providing the recess 40 in the crown 19, the crown can be compressed downwardly when vertically downward impact forces are encountered when a player engages the top of the crown when running the bases. The top surface of the base surrounding the crown is also compressed to some extent when engaged by a runner due to the deformable ribs formed on the underside of the base surrounding the recess. Although the ribs support the base in the radially intermediate regions thereof when the base is positioned in place, the ribs are resiliently deformable in a vertical direction and are compressible to some extent when runners step on the base in the regions of the ribs. By accommodating downward movement of the crown when the base is impacted at the center thereof, a more uniform vertical deformation can be accomplished over a substantial part of the base including the crown and that portion of the top wall of the base above the ribs. This is not possible to achieve where the crown or hub of the base in which the post is embedded is essentially solid throughout the thickness of the crown or hub and wherein the bottom of the crown or hub engages the ground directly.

It will be noted that when the crown 19 moves vertically downwardly during impact as above described, the center web 18 and mounting plate 36 likewise move downwardly, thereby extending the post 34 further into the embedded sleeve 30. The space between the bottom of the plate 34 and the ground surface as shown in FIG. 4 is such as to accommodate such vertical movement, and a spacing of 0.75 inches has proved very satisfactory. The resiliency of the rubber material is such that when the vertical impact forces caused by the runner engaging a top of the base have ceased, the center leg returns to its FIG. 4 position, with such movement being aided by the return of the resiliently deformable ribs to their unstressed condition. A piston-cylinder relationship thus exists between the post and the fixed sleeve to accommodate the vertical movement of the post during impact as described.

The extent to which the crown of the base can depressed upon vertical impact can be controlled in several ways, for example, by controlling the depth of the recess 40, the depth of the counterbore 42 which controls the positioning of the heads 50 of the mounting bolts, and the angle of the taper 60 of the ribs outwardly from the center web. It will be noted in FIG. 3 that the mounting bolts and embossed areas 52 in which the inserts are embedded are located adjacent the juncture of a rib 16 with the center rib. Resilient deformation of the ribs during vertical impact is therefore more quickly transferred to the center web, and vice versa, and consequently the mounting plate and post.

The deformable base in accordance with the present invention thus provides a base which is not only laterally deformable when a player slides directly into a side of the base, but also vertically deformable when the runner engages the top of the base when circling the bases. The present invention is uniquely able to absorb the vertical impact forces fairly uniformly across the entire top of the base thereby eliminating "soft" and "hard" areas that could cause injury to the runner. The downward movement in the region of the crown in response to vertical impact forces can be correlated with the resilient deformation in the surrounding ribs to provide the uniformity desired.

What is claimed is:

1. A deformable base, comprising:

a) resilient top and peripheral walls defining the above ground portion of the base and also defining an above ground base interior;

b) resiliently deformable ribs arranged within the base interior, said ribs being spaced from each other and having inner ends, and outer ends attached to the peripheral wall, and having a vertical dimension over a substantial portion of each rib such that the bottoms of said ribs and said peripheral walls are in a bottom plane and define the bottom of the base which engages the ground;

c) a resilient center web extending downwardly from said top wall and to which the inner ends of said ribs are connected, said center web having a bottom surface located above said bottom plane defined by the bottoms of said ribs and said peripheral walls, said center web defining therewithin a downwardly opening central recess the upper end of which is defined by said top wall;

d) a mounting plate extending across said recess and mounted on said web, said mounting plate being located above said bottom plane;

e) a post fixed to said mounting plate;

f) a retaining sleeve embedded in the ground for receiving and retaining said post, and wherein g) said mounting plate and the top wall in the center region thereof defining said central recess are resiliently depressed relative to said bottom plane when a player contacts the base in the center thereof, said plate when depressed moving said post further into said retaining sleeve, the resiliency of said top wall and said center web when contact ceases returning the top wall and plate to a rest position in which the plate is elevated above said bottom plane.

2. The deformable base of claim 1, wherein said mounting plate is mounted on said center web by means of a plurality of spaced, internally threaded inserts embedded in said center web, said mounting plate being formed with a plurality of corresponding openings adapted to be aligned with said inserts, and mounting bolts extending through said openings in said mounting plate for threaded engagement in said inserts.

3. The deformable base of claim 2, wherein the thickness of said center web is greater in the regions of said inserts, and relatively reduced in the regions between inserts thereby to provide increased support for the inserts without substantially diminishing resilient deformability.

4. The combination of claim 2, wherein said inserts are embedded in the center web at points of juncture of said ribs to said center web thereby correlating more uniformly the resilient deformation of said ribs and said center web during and following vertical impact forces.

* * * * *